US006269674B1

(12) United States Patent
Sperko

(10) Patent No.: US 6,269,674 B1
(45) Date of Patent: Aug. 7, 2001

(54) TUBULAR FITTING, TOOL AND METHOD

(76) Inventor: Walter J. Sperko, 4803 Archwood Dr., Greensboro, NC (US) 27406

( * ) Notice: Subject to any disclaimer, the term of this patent is extended or adjusted under 35 U.S.C. 154(b) by 0 days.

(21) Appl. No.: 09/476,824

(22) Filed: Jan. 3, 2000

Related U.S. Application Data

(63) Continuation-in-part of application No. 09/377,538, filed on Aug. 19, 1999.

(51) Int. Cl.[7] ..... B21D 19/10
(52) U.S. Cl. ..... 72/409.19; 72/414; 72/370.1
(58) Field of Search ..... 72/409.01, 409.12, 72/409.19, 414, 370.04, 370.1

(56) References Cited

U.S. PATENT DOCUMENTS

| | | | | |
|---|---|---|---|---|
| 3,375,693 | * | 4/1968 | Hougen | 72/414 |
| 3,624,876 | * | 12/1971 | Irvin | 72/409.01 |
| 3,998,376 | | 12/1976 | Haines | 228/154 |
| 4,158,955 | * | 6/1979 | Bustin | 72/414 |
| 4,286,372 | * | 9/1981 | Batcheller | 72/370.1 |
| 4,318,291 | | 3/1982 | Thompson | 72/317 |
| 4,470,291 | * | 9/1984 | Gibb | 72/414 |
| 4,523,780 | | 6/1985 | Cheer | 285/399 |
| 4,531,397 | * | 7/1985 | Pratt | 72/451 |
| 5,071,174 | | 12/1991 | Griffin et al. | 285/173 |
| 5,810,054 | | 9/1998 | Goulet et al. | 138/109 |

FOREIGN PATENT DOCUMENTS

| | | | | |
|---|---|---|---|---|
| 1085076 | * | 1/1955 | (FR) | 72/409.01 |
| 2671 | * | of 1888 | (GB) | 72/414 |
| 362330 | * | 12/1931 | (GB) | 72/409.01 |
| 1250362 | * | 10/1971 | (GB) | 72/409.19 |

OTHER PUBLICATIONS

T–Drill Industries, Inc. brochure 6 pages Oct. 4, 1993 date.

* cited by examiner

*Primary Examiner*—Daniel C. Crane

(57) ABSTRACT

A method and tools for forming ridges or dimples in tubular members such as copper pipes is provided. A manual tool has a pair of jaws which can be adjustably positioned and has a threaded ram affixed to one of the jaws for rotation. The jaws are adjustable for holding various thicknesses of pipe walls in firm engagement as the ram is manually rotated to form a ridge in the pipe wall. A hydraulic tool is also described for high production requirements.

7 Claims, 11 Drawing Sheets

TUBULAR FITTING, TOOL AND METHOD

This is a continuation-in-part of pending patent application Ser. No. 09/377,538 filed Aug. 19, 1999.

FIELD OF THE INVENTION

The invention herein pertains to tubular fittings, connections and tools used therefor and specifically concerns reconditioning copper fittings as are used in potable water, heating and air conditioning systems to effectively shorten the socket length.

BACKGROUND AND OBJECTIVES OF THE INVENTION

Tubes or pipes formed from copper have been the preferred type for homeowners, engineers and architects for many years due to the availability, durability and convenience in assembly. Copper tubing ranging from about one-quarter inch (0.63 cm) to six inches (15.24 cm) are commercially available along with copper socket fittings such as elbows, T's, connectors and the like. Tubes and fittings are normally joined by soldering by first inserting the tube into the fitting socket and then by heating the tube and fitting to a sufficient temperature (approximately 450° F.; 232° C.) to allow the tin based solder to flow into the fitting to provide a watertight joint once the solder hardens upon cooling. A one inch (2.54 cm) copper tube may have a socket penetration length of about 1.9 cm (0.75") in order to insure a watertight, secure joint upon soldering.

When copper tubes and fittings are joined by brazing rather than by soldering a connection or joint of higher quality is provided in that the brazed joint can withstand greater abuse, temperatures and adverse conditions without rupturing as opposed to conventional soldered connections. However, brazing is more expensive, from both a materials and time stand point, and higher operating temperatures are required. Brazing is normally conducted at about 704° C. (1300° F.) as opposed to about 232° C. (450° F.) for soldering.

Brazed joints however require less insertion length or overlap due to the greater strength of the brazing alloy between the fitting socket and inserted tube for a more durable joint than soldered joints.

As a safety precaution, fitting manufacturers provide deep sockets to insure a sufficient connection, as the less expensive soldering operation is usually performed. For a one inch (2.54 cm) linear connector, each socket may have a depth of 0.75" (1.9 cm) whereas for brazing only 0.28" (0.71 cm) would be required. Thus standard tubular fittings which are brazed usually have a great excess of overlap which is unnecessarily expensive and more difficult to make properly.

It is therefore an objective of the invention to provide a method of reconditioning conventional copper socket fittings to reduce the effective socket depth when brazing.

It is still another objective of the present invention to recondition copper sockets by placing dimples or ridges therein to terminate the penetration of the inserted tube.

It is yet another objective of the present invention to provide a convenient tool to recondition fittings which will be used in brazing operations.

It is also an objective of the present invention to provide a method of joining tubular members having different diameters.

It is yet another objective of the present invention to provide a fitting which has been reconditioned for brazing purposes.

Various other objectives and advantages of the present invention will become apparent to those skilled in the art as a more detailed description is set forth below.

SUMMARY OF THE INVENTION

The aforesaid and other objectives are provided by a method of joining pipes or tubes by the use of reconditioned fittings such as elbows, T's, linear connectors or the like. Conventional socket fittings are reconditioned or modified by forming ridges within the sockets to limit the penetration by the inserted tube. Thereafter the inserted tube and fitting are joined by brazing to insure a watertight, secure joint. A fitting which may be of standard manufacture is modified without distorting or changing the original diameter by placing it in a manual or motorized tool which forms ridges or indentions, continuous or otherwise such as "dimples" within the socket at a point, substantially less than the total socket length. Such indentations thus effectively reduce the length of the socket and provide less overlap with an inserted tube. Brazing compounds or other adherents are then applied to form a rigid, tight joint which is waterproof and will withstand adverse use conditions. By allowing less tube/fitting overlap, a more efficient use of the tube is provided and less adherent is required for the connection. The overlap may range from about one-half to less than one-third of the normal (solder) overlap length, depending on the particular pipe size and diameter.

DETAILED DESCRIPTION OF THE PREFERRED EMBODIMENTS AND OPERATION OF THE INVENTION

Figure 2:
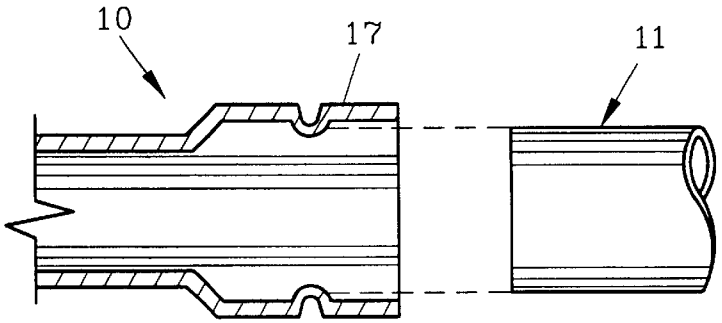
FIG. 2 illustrates a partial fitting of the invention prior to insertion of a tubular member.
Figure 3:
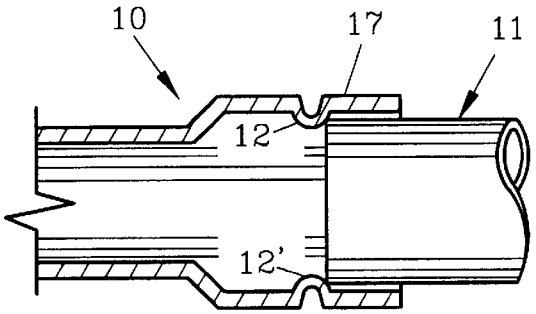
FIG. 3 shows tubular member of FIG. 2 inserted into the socket fitting.

For a better understanding of the invention and its operation, turning now to the drawings, FIG. 2 shows a partial view of a preferred reconditioned socket fitting of the invention in cross-sectional view prior to insertion of tubular member 11 which may be for example, a copper pipe which is dimensioned for reception by socket 17. As seen in FIG. 3, tubular member 11 has been inserted into socket 17 and abuts ridges 12, 12' formed therein. Ridges 12, 12' preferably are dimples pressed into socket 17 as will be hereinafter described in more detail.

Figure 4:
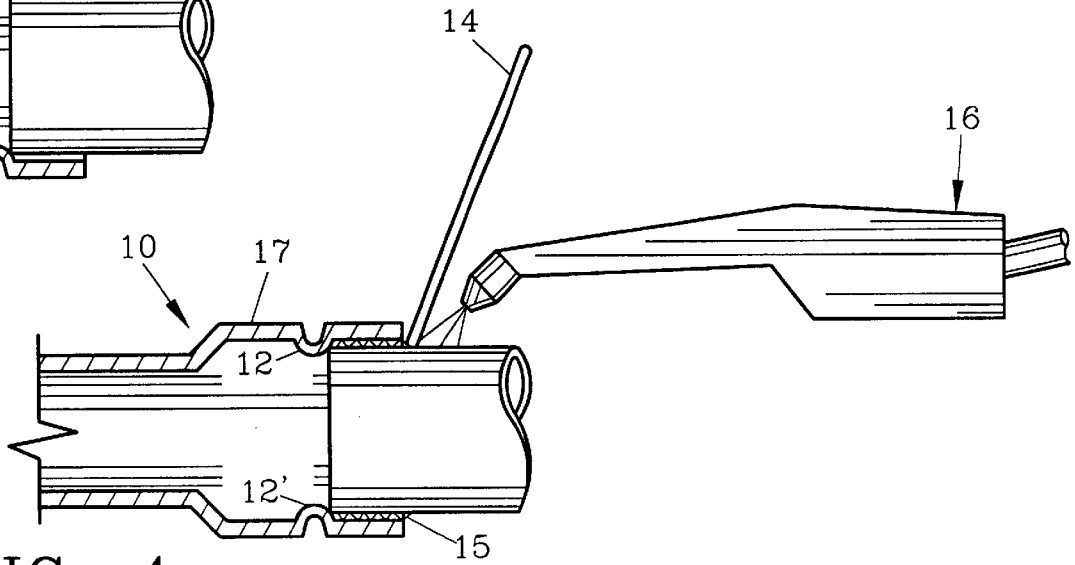
FIG. 4 depicts the socket fitting and tubular member of FIG. 3 being brazed with the use of a conventional torch.

Once tubular member 11 has been fully inserted into socket 17 which as shown in FIGS. 3 and 4 is about one-half of the normal socket length, metal adherent 15 such as a conventional brazing metal composition is applied as usual between tubular member 11 and the inner walls of socket 17 to rigidly connect tubular member 11 and socket fitting 10 (FIG. 4). Heat to melt and flow adherent 15 is supplied utilizing a conventional brazing rod 14 and standard brazing torch 16 as is well known in the industry. While ridges 12, 12' are shown as "dimples" such ridges may be continuous and may extend the entire interior circumference of socket 17 or may be non-continuous as desired. The purpose of such ridges is to terminate the penetration of tubular member 11 as shown.

Figure 1:
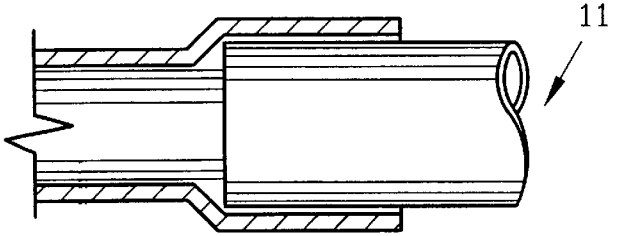
FIG. 1 provides a cross sectional partial view of a standard socket fitting joined to a tubular member as is usual in the industry.

Joints and connections which are adhered through brazing require a shorter overlap length than those adhered by conventional soldering techniques as illustrated in FIG. 1. Table 1 below demonstrates the socket length of brazed joints compared to soldered joints for various pipe sizes:

TABLE 1

COMPARISON LENGTH OF SOLDER JOINT AND BRAZE JOINT FITTINGS

| PIPE SIZE | SOLDER JOINT SOCKET LENGTH | BRAZED JOINT SOCKET LENGTH |
|---|---|---|
| ¼" (.63 cm) | 0.31" (.78 cm) | 0.17" (.43 cm) |
| ⅜" (.95 cm) | 0.38" (.96 cm) | 0.20" (.50 cm) |
| ½" (1.27 cm) | 0.50" (1.27 cm) | 0.22" (.55 cm) |
| ¾" (1.90 cm) | 0.62" (1.57 cm) | 0.25" (.63 cm) |
| 1" (2.54 cm) | 0.75" (1.90 cm) | 0.28" (.71 cm) |
| 1¼" (3.17 cm) | 0.97" (2.46 cm) | 0.31" (.78 cm) |
| 1½" (3.81 cm) | 1.09" (2.76 cm) | 0.34" (.86 cm) |
| 2" (5.08 cm) | 1.34" (3.40 cm) | 0.40" (1.01 cm) |
| 2½" (6.35 cm) | 1.47" (3.73 cm) | 0.47" (1.19 cm) |
| 3" (7.62 cm) | 1.66" (4.21 cm) | 0.53" (1.34 cm) |
| 3½" (8.89 cm) | 1.91" (4.85 cm) | 0.59" (1.49 cm) |
| 4" (10.16 cm) | 2.16" (5.48 cm) | 0.64" (1.62 cm) |
| 5" (12.70 cm) | 2.66" (6.75 cm) | 0.73" (1.85 cm) |
| 6" (15.24 cm) | 3.09" (7.84 cm) | 0.83" (2.10 cm) |

As shown, a conventional one inch (1") copper pipe may require a soldered socket length of 0.75" (1.90 cm) whereas the same connection when adhered through brazing requires a little over a third (⅓) of the socket length (0.28", 0.71 cm).

Figure 5:
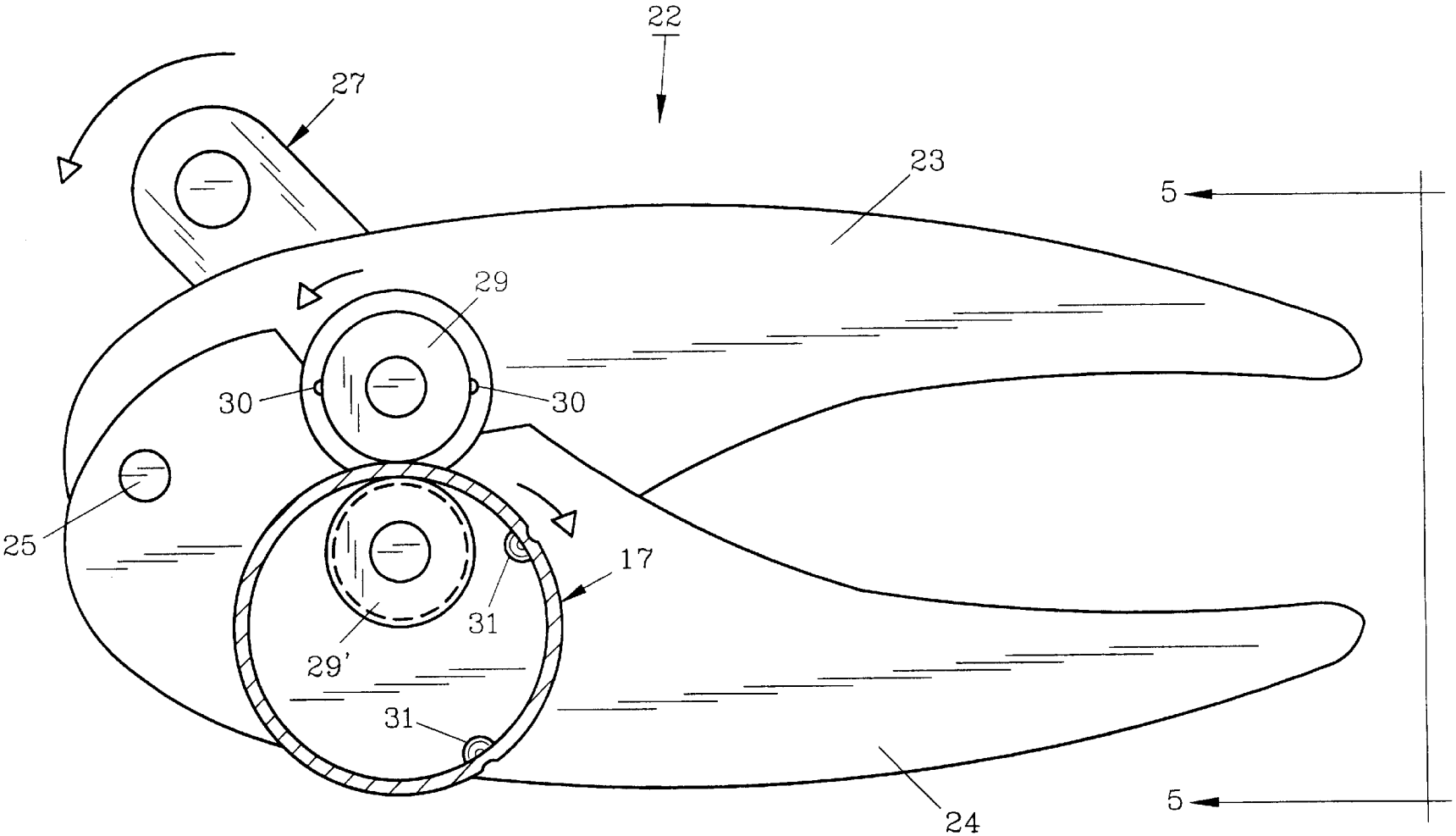
FIG. 5 pictures a right side elevational view of a ridge forming tool of the invention with a partial fitting.
Figure 7:
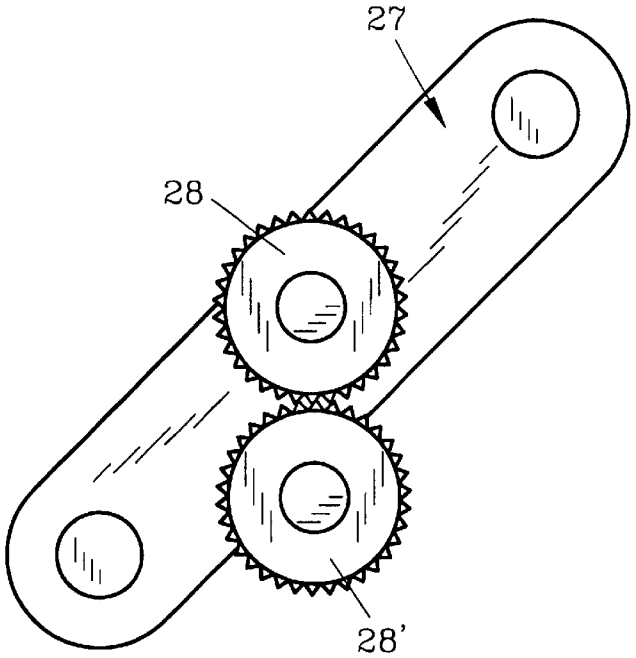
FIG. 7 features a portion of the tool as seen in FIG. 6 along lines 6–6.
Figure 6:
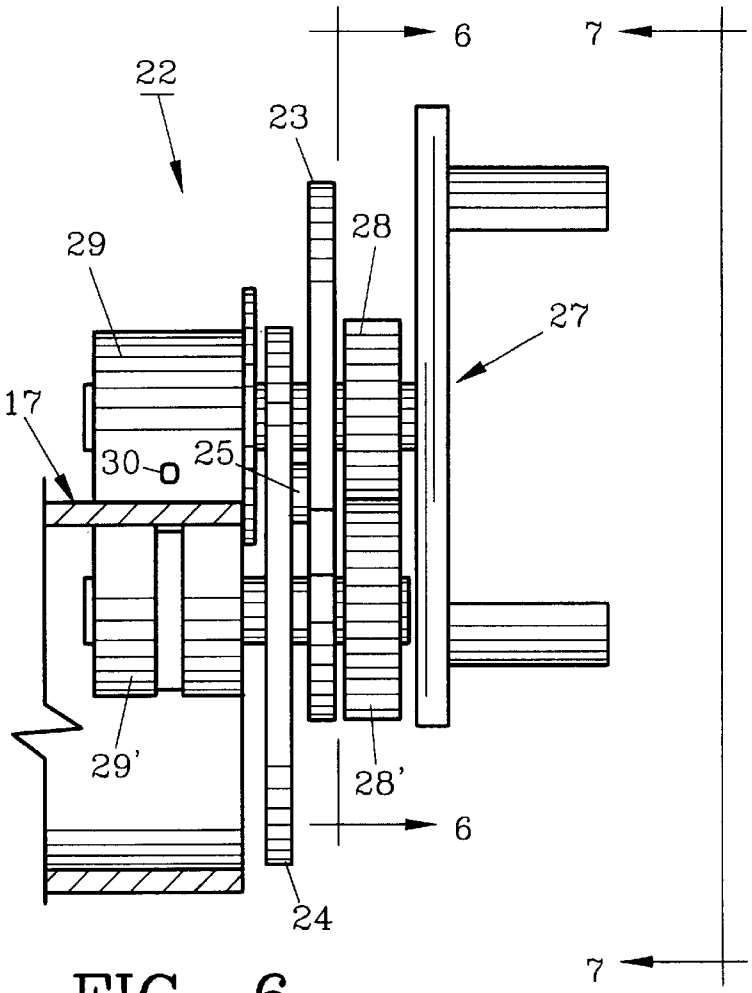
FIG. 6 demonstrates the tool as seen along lines 5—5 of FIG. 5.
Figure 8:
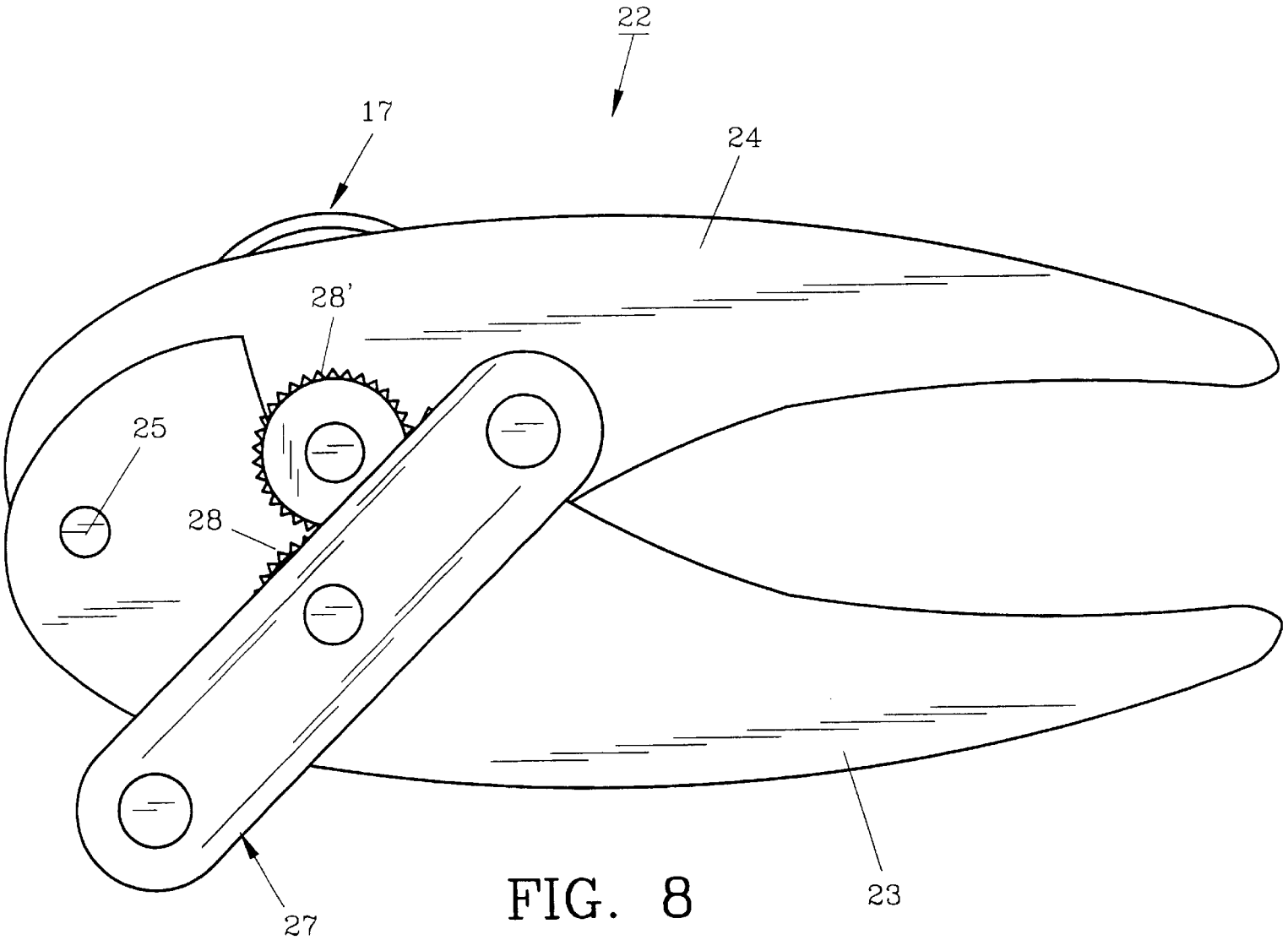
FIG. 8 shows an inverted elevational view of the tool as seen along lines 7—7 of FIG. 6.

Various tools can be used to reduce the socket length required for the present invention by the placement of ridges such as dimples or the like therein. In FIGS. 5–8, the preferred manual tool is provided which is portable and can be used on the job for reconditioning conventional fittings. As seen in FIGS. 5, 6, 7 and 8 ridge forming tool 22 includes an upper handle 23 and a lower handle 24 which pivot at axle 25 for loading a standard fitting such as socket 17 (seen in partial form for clarity). Handles 23, 24 are held for example by the left hand whereas crank 27 can then be turned with the right hand. As shown in FIG. 6, crank 27 turns gears 28, 28' which in turn drive rollers 29, 29' respectively for rotating socket 17. Roller 29 includes a rear stop and one or more nibs 30 which distort socket 17 to form ridges or dimples 31 therein as shown in FIG. 5. Roller 29' which supports socket 17 is seen with a central groove to accommodate nibs 30 and the distorted metal of socket 17. One or more nibs 30 can be formed on roller 29 so as to form one or more dimples 31 in socket 17. However, it has been found that three dimples 31, equally spaced along the interior of socket 17 are preferred. More nibs or a continuous protrusion can be employed if a substantially continuous ridge is desired. Once socket 17 has been processed with dimples 31, handles 23 and 24 are released and opened by manual rotation and another fitting (socket) can thus be inserted and the process repeated. As would be understood, a motorized version of ridge forming tool 22 could be easily constructed, depending on the capacity and the needs of the particular user.

Figure 10:
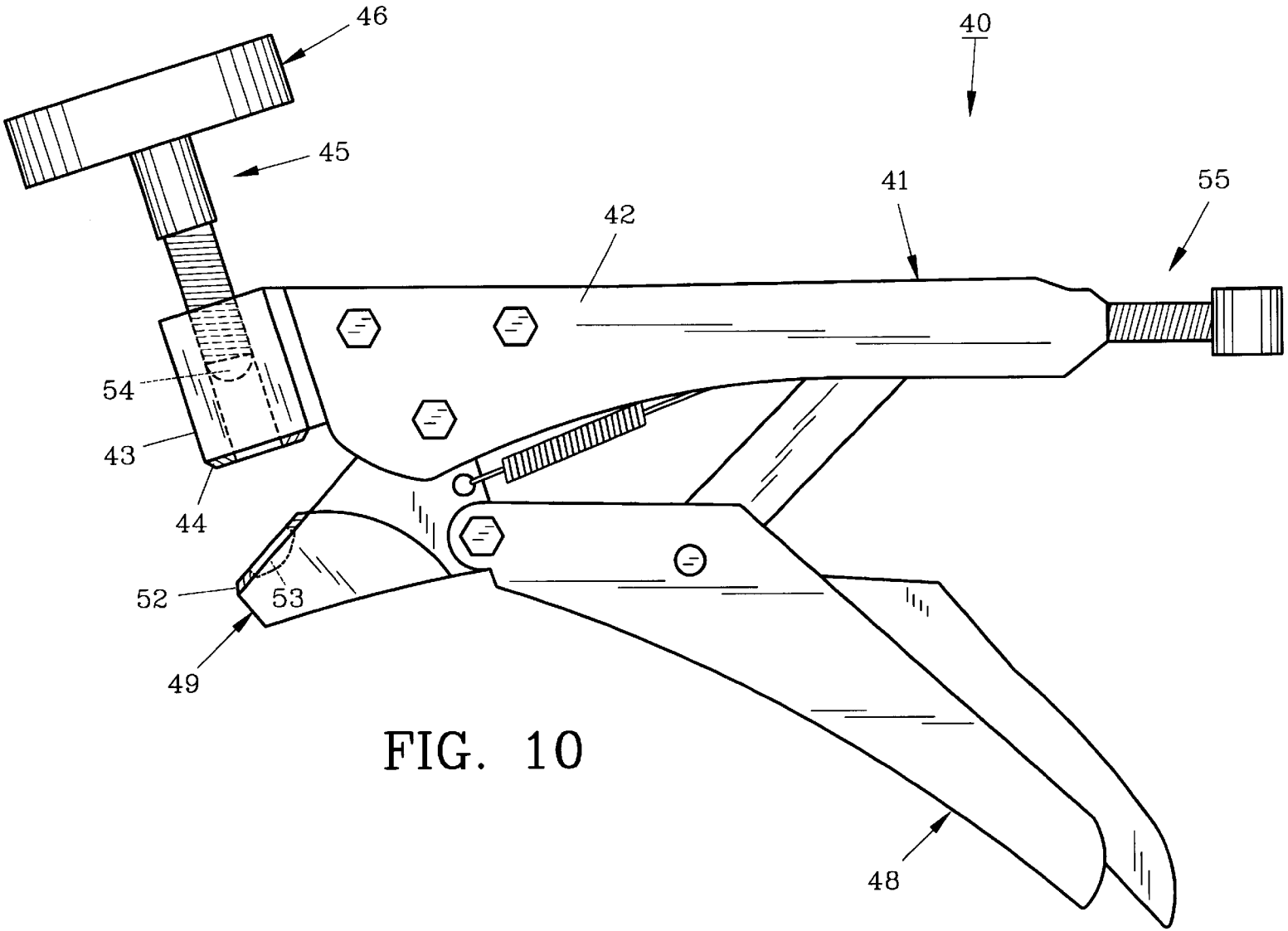
FIG. 10 demonstrates a side view of yet another embodiment of a tool for reconditioning a tubular member.
Figure 11:
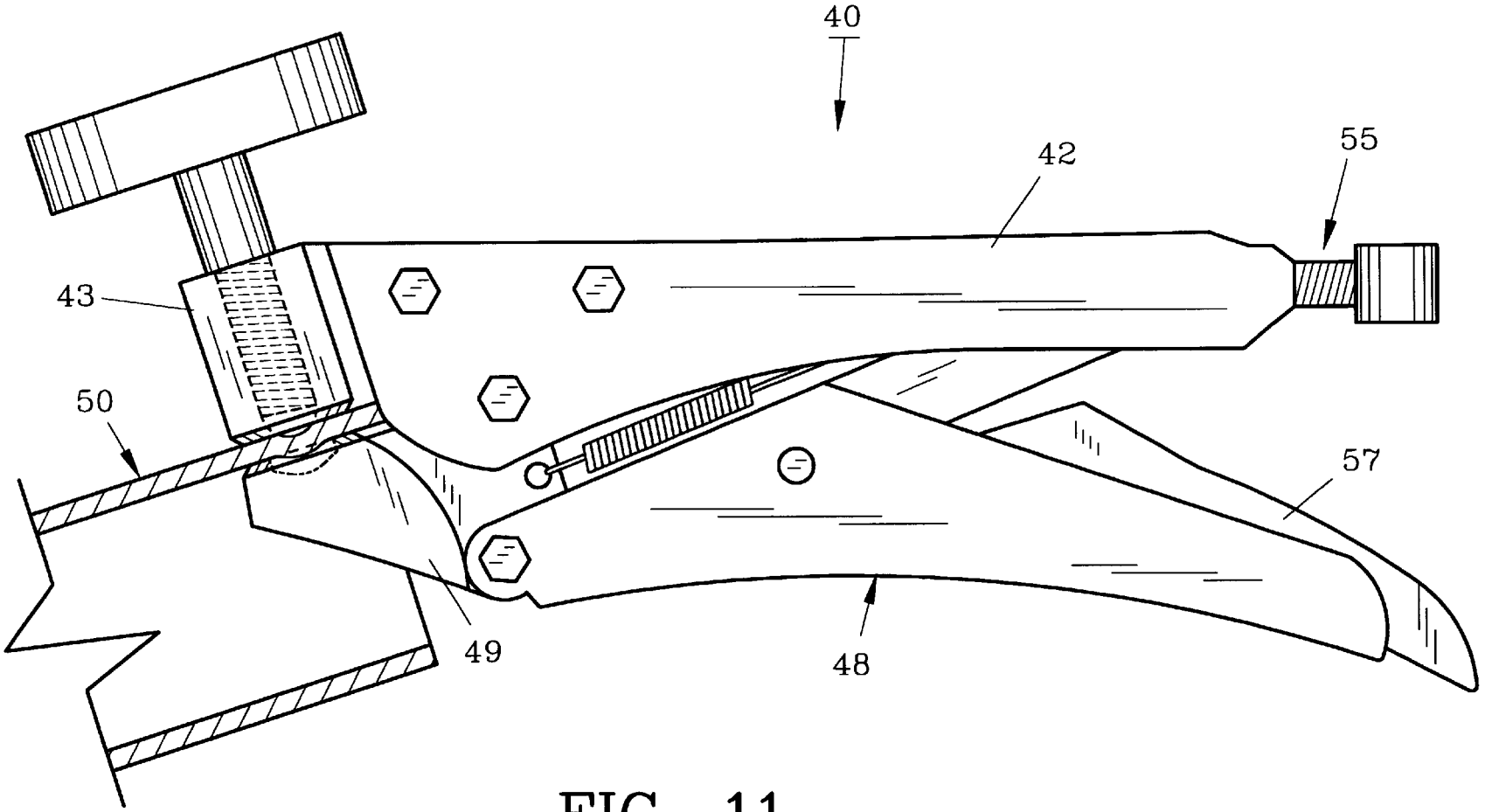
FIG. 11 depicts the tool of FIG. 10 as it places a dimple in a section of copper pipe.

Another embodiment of a tool to recondition pipe fittings is shown in FIG. 10 whereby tool 40 is shown having a handle assembly 41 similar to conventional "vice grip" pliers. Handle assembly 41 includes upper handle 42 which is rigidly affixed to top jaw 43. Top jaw 43 includes beveled platen 44 through which threaded ram 45 is driven. Threaded ram 45 includes wide knob 46 for manually rotating ram 45. Lower handle 48 can be closed as shown in FIG. 11 whereby upper jaw 43 and lower jaw 49 are brought into clamping engagement with copper pipe 50 (shown in cross-sectional view). Lower jaw 49 includes beveled platen 52 having a depression 53 centrally thereof to receive tip 54 of ram 45. In use, reconditioning tool 40 is placed on a tubular member such as pipe 50 as shown in FIG. 11 and handle 48 is closed (also shown in FIG. 11). Threaded adjusting shaft 55 can then be rotated to make an exact closing adjustment to properly clamp pipe section 50. Once pipe section is suitably clamped between jaws 43 and 49, ram 45 is manually rotated whereupon tip 54 will contact the outer wall surface of pipe 50 and distort the pipe wall as it forces it into depression 53 of lower platen 52. Once this ridge or dimple has been formed, release handle 57 is urged upwardly, thereby releasing lower jaw 49 for removing pipe 50.

Figure 12:
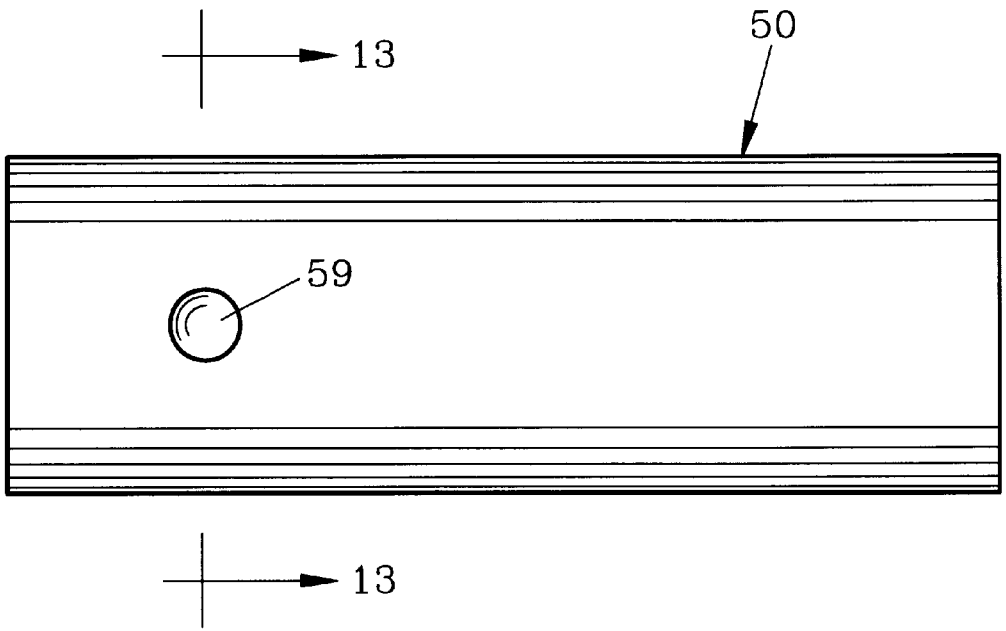
FIG. 12 illustrates the tubular member seen in FIG. 11 with a trio of dimples therein.
Figure 13:
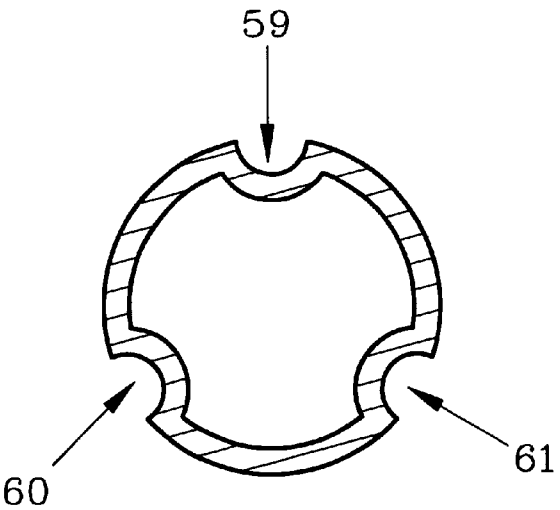
FIG. 13 shows a cross section of the pipe seen along lines 13—13 of FIG. 12.

In FIG. 12, dimple 59 is shown and as seen in FIG. 13, one or more dimples may be formed therein as desired such as dimples 60, 61 using reconditioning tool 40 to form one dimple at a time by releasing pipe 50 from tool 40, rotating ram 45 in the opposite direction to raise ram 45, rotating pipe 50 and then reclamping pipe 50 in tool 40. Again ram 45 is rotated to drive ram tip 54 into pipe 50. This process is repeated as needed to obtain the number of dimples desired.

Figure 14:
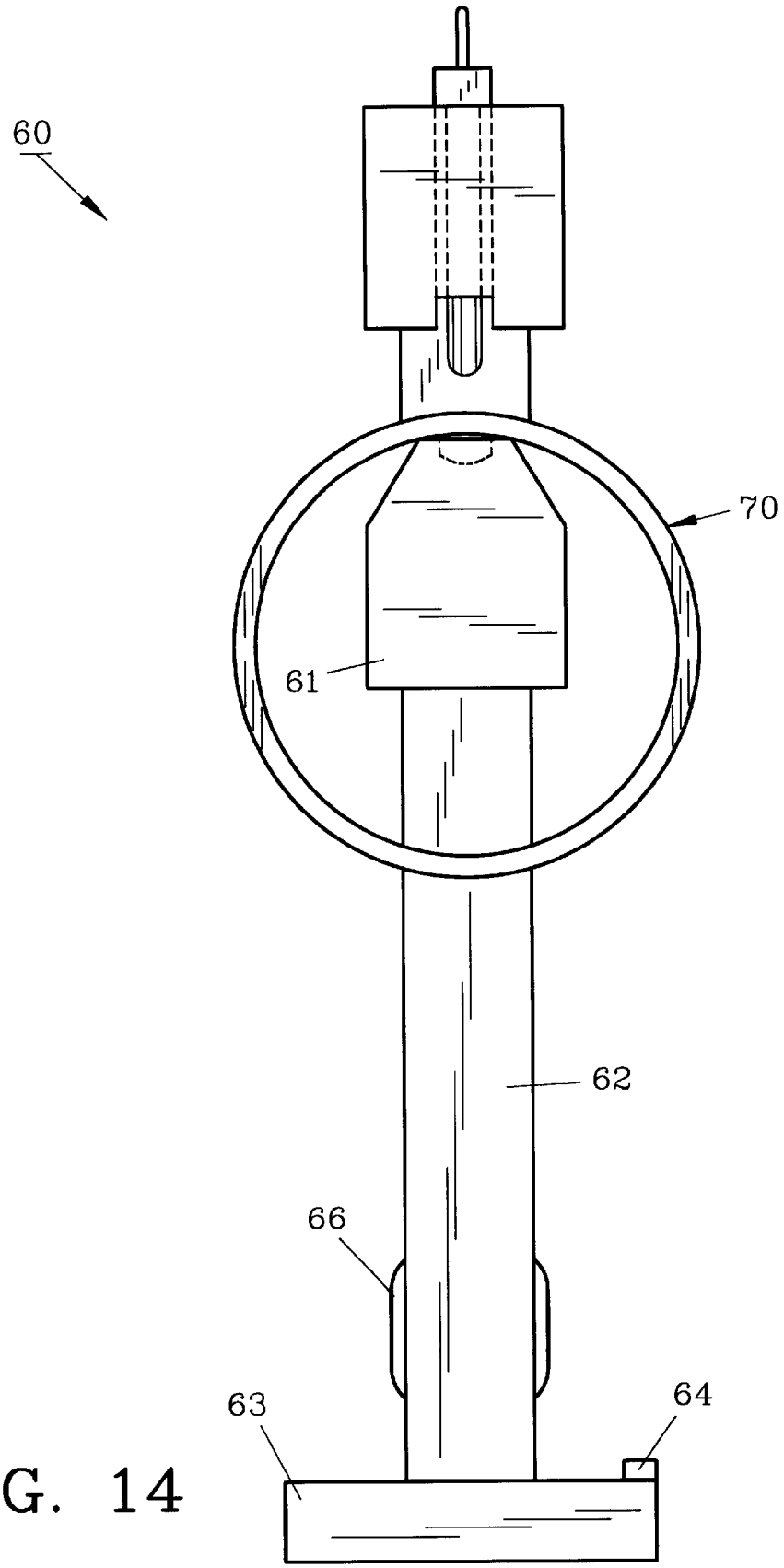
FIG. 14 shows yet another embodiment of a pipe ridge forming tool seen in a front elevational view.
Figure 15:
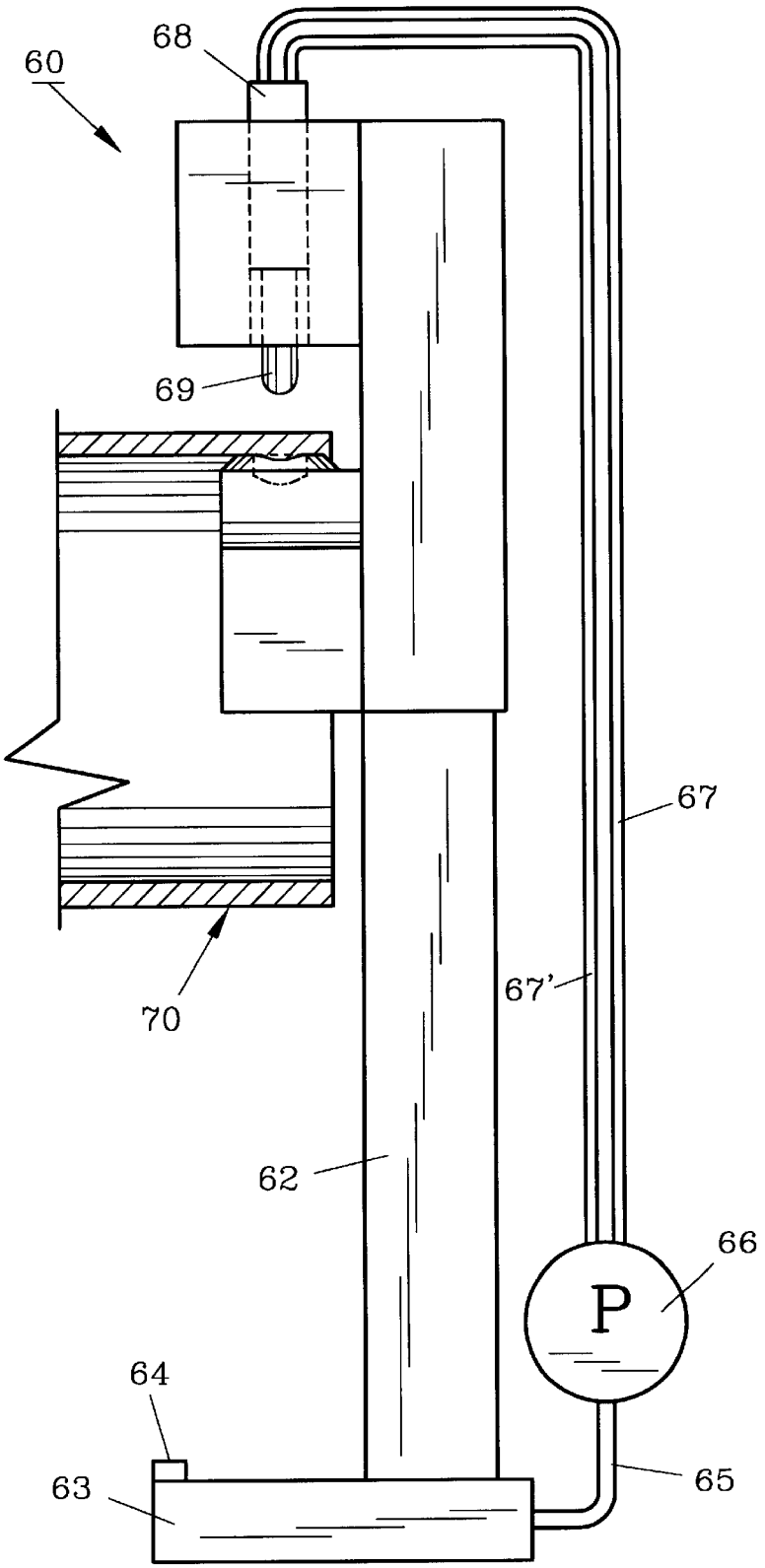
FIG. 15 depicts the tool as shown in FIG. 14 seen in a side elevational view.

FIG. 14 provides dimple forming tool 60 which may be mounted on a table or other stable location. Tool 60 includes platen 61 which is shown supporting tubular member 70 which may be for example copper tubing. Platen 61 is positioned on stanchion 62 supported on base 63. Base 63 includes electrical switch 64 which is connected through conduit 65 to operate electric pump 66 which forces hydraulic fluid through lines 67, 67' which operate hydraulic cylinder 68. Hydraulic cylinder 68 drives ram 69 for forming dimples in tubular member 70 as needed.

Figure 16:
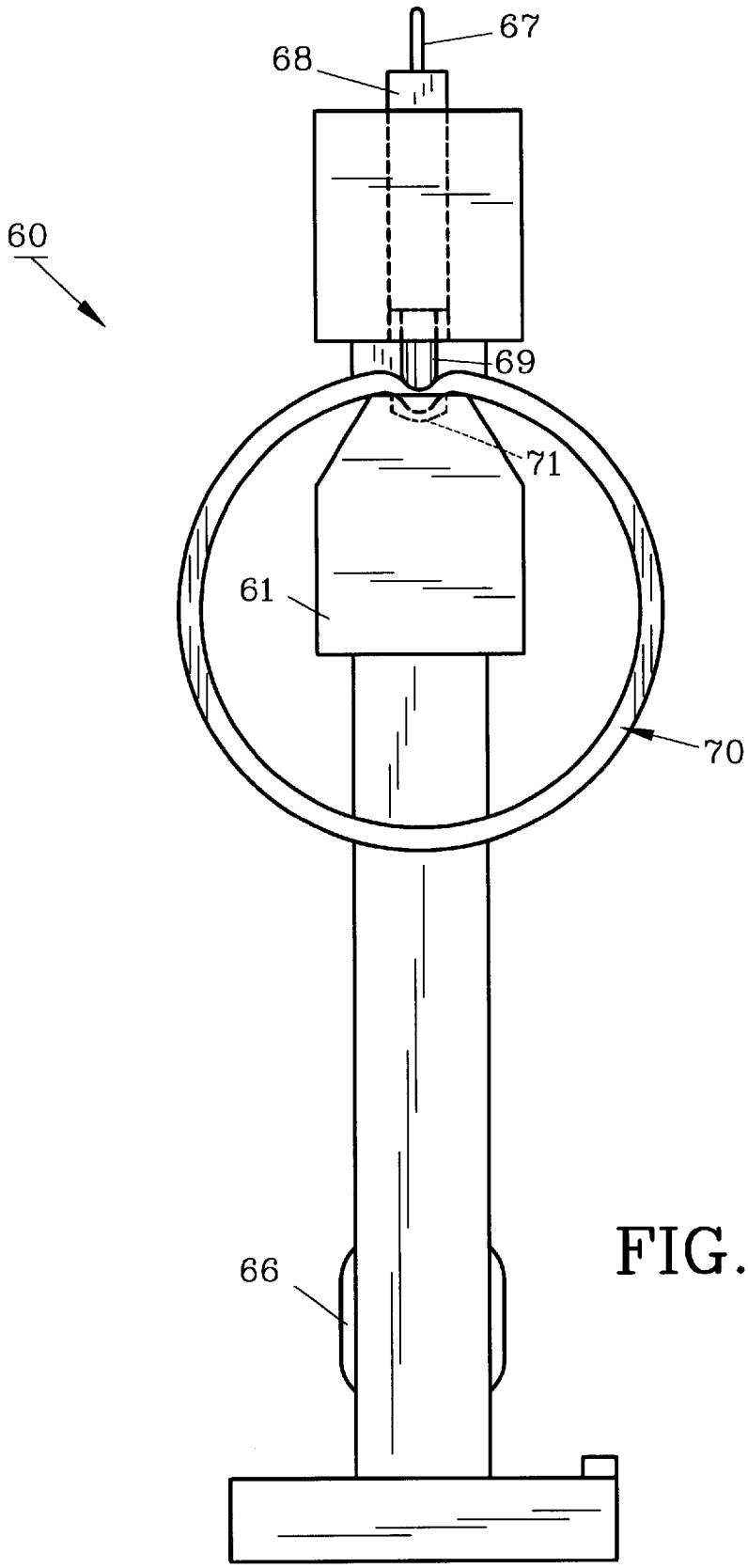
FIG. 16 pictures the tool shown in FIG. 14 but with the ram extended into the tubular member.

As seen in FIG. 16, hydraulic cylinder 68 has extended ram 69 to thereby place a dimple in tubular member 70 by forcing a portion of the tubular member 70 into depression 71. Tubular member 70 can be removed from platen 61 and rotated for placement of additional dimples as needed. Electric, pneumatic or mechanical rams could also be employed as desired.

Figure 9:
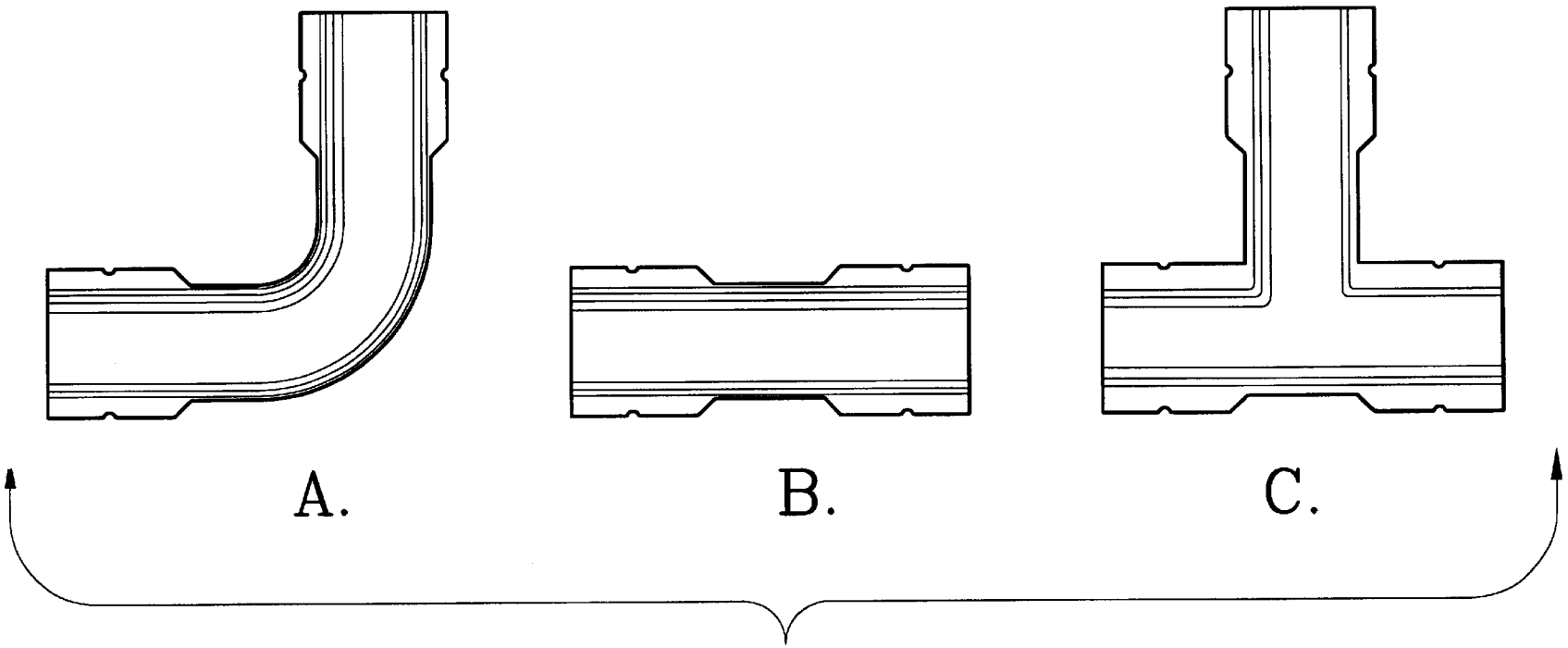
FIG. 9 demonstrates a series of fittings of the present invention.

While the present invention in its preferred form is used with copper tubular members and fittings such as shown in FIG. 9, aluminum or other malleable metal fittings may also be used. In addition, two telescoping tubular members or pipes may be joined as described above without a separate fitting. Also, while brazing compositions are the preferred adherents herein, other adherents may be used provided they have the strength and durability required. Thus, the illustrations and examples provided herein are for explanatory purposes and are not intended to limit the scope of the appended claims.

I claim:

1. A tool for reconditioning a tubular member comprising:

(a) an upper handle, a top jaw, said top jaw joined to said upper handle;

(b) a lower handle, a bottom jaw, said bottom jaw joined to said lower handle, said upper handle pivotally joined to said lower handle, said bottom jaw sized to engage the interior of the tubular member;

(c) a ram, said ram joined to said top jaw, said ram for forming a ridge in the tubular member; and (d) a knob, said knob attached to said ram, said knob positioned above said top jaw, said knob having a width greater than said ram for manual rotation thereof whereby the interior and exterior of the tubular member is securely held between said top and said bottom jaws as said ram is rotated by said knob to form a ridge in the tubular member.

2. The tool of claim 1 wherein said ram is threadably attached to said top jaw.

3. The tool of claim 1 wherein said tool further comprises a pair of beveled platens, one of said beveled platens located on said upper jaw and the other of said pair of beveled platens located in opposing relation on said lower jaw.

4. The tool of claim 1 wherein said upper handle comprises an adjusting rod, said adjusting rod for adjusting the distance between said top and said bottom jaws.

5. The tool of claim 1 further comprising a beveled platen, said beveled platen affixed to said lower jaw.

6. The tool of claim 5 wherein said beveled platen defines a depression, said depression for receiving said ridge.

7. A tool for reconditioning a tubular member comprising:

(a) an upper handle, a top jaw, said top jaw joined to said upper handle;

(b) a lower handle, a bottom jaw, said bottom jaw joined to said lower handle, said upper handle pivotally joined to said lower handle;

(c) a ram, said ram joined to said top jaw, said ram for forming a ridge in the tubular member;

(d) a knob, said knob attached to said ram, said knob positioned above said top jaw, said knob having a width greater than said ram for manual rotation thereof; and (e) a pair of beveled platens, one of said beveled platens located on said upper jaw and the other of said pair of beveled platens located in opposing relation on said lower jaw.

* * * * *